US009783382B2

(12) United States Patent
Morino et al.

(10) Patent No.: US 9,783,382 B2
(45) Date of Patent: Oct. 10, 2017

(54) TRANSPORT DEVICE AND IMAGE FORMING APPARATUS

(71) Applicant: FUJI XEROX CO., LTD., Tokyo (JP)

(72) Inventors: Takanori Morino, Kanagawa (JP); Hidehiko Yamaguchi, Kanagawa (JP); Hideki Moriya, Kanagawa (JP); Tsuyoshi Sunohara, Kanagawa (JP); Takahito Chiba, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/001,599

(22) Filed: Jan. 20, 2016

(65) Prior Publication Data

US 2017/0008715 A1 Jan. 12, 2017

(30) Foreign Application Priority Data

Jul. 6, 2015 (JP) ..... 2015-135535

(51) Int. Cl.

*B41J 29/38* (2006.01)
*G03G 15/00* (2006.01)
*B65H 7/12* (2006.01)

(52) U.S. Cl.

CPC ..... *B65H 7/125* (2013.01); *G03G 15/657* (2013.01); *G03G 15/6529* (2013.01); *G03G 2215/00738* (2013.01)

(58) Field of Classification Search

CPC ..... G03G 2215/00738
See application file for complete search history.

(56) References Cited

U.S. PATENT DOCUMENTS 6,029,023 A * 2/2000 Munemori ..... G03G 15/01 399/299
2009/0309297 A1* 12/2009 Murakami ..... B65H 5/062 271/226
2010/0226676 A1* 9/2010 Funamoto ..... G03G 15/161 399/66
2011/0150549 A1* 6/2011 Imaizumi ..... B65H 7/02 399/388
2013/0243508 A1* 9/2013 Mori ..... G03G 15/2028 399/400

FOREIGN PATENT DOCUMENTS

JP 2003-029555 A 1/2003
JP 2003-285484 A 10/2003
JP 2005148767 A * 6/2005 ..... G01B 7/06
JP 2009-202955 A 9/2009

* cited by examiner

*Primary Examiner* — Blake A Tankersley
*Assistant Examiner* — Ruben Parco, Jr.
(74) *Attorney, Agent, or Firm* — Oliff PLC

(57) ABSTRACT

Provided is a transport device including a first transport section that is driven at a first transport speed and transports a recording medium interposed therein, a second transport section that is driven at a speed different from the first transport speed, is located at a downstream of the first transport section in a transport direction, and transports the recording medium interposed therein, a detection section that detects variations in a driving load of the second transport section before and after the recording medium is discharged from the first transport section, and a derivation section that derives a thickness of the recording medium based on the variations.

4 Claims, 8 Drawing Sheets

TRANSPORT DEVICE AND IMAGE FORMING APPARATUS

CROSS-REFERENCE TO RELATED APPLICATIONS

This application is based on and claims priority under 35 USC 119 from Japanese Patent Application No. 2015-135535 filed Jul. 6, 2015.

BACKGROUND

Technical Field

The present invention relates to a transport device and an image forming apparatus.

SUMMARY

According to an aspect of the invention, there is provided a transport device including:

a first transport section that is driven at a first transport speed and transports a recording medium interposed therein;

a second transport section that is driven at a speed different from the first transport speed, is located at a downstream of the first transport section in a transport direction, and transports the recording medium interposed therein;

a detection section that detects variations in a driving load of the second transport section before and after the recording medium is discharged from the first transport section; and a derivation section that derives a thickness of the recording medium based on the variations.

BRIEF DESCRIPTION OF THE DRAWINGS

Exemplary embodiments of the present invention will be described in detail based on the following figures, wherein.

DETAILED DESCRIPTION

Figure 1:
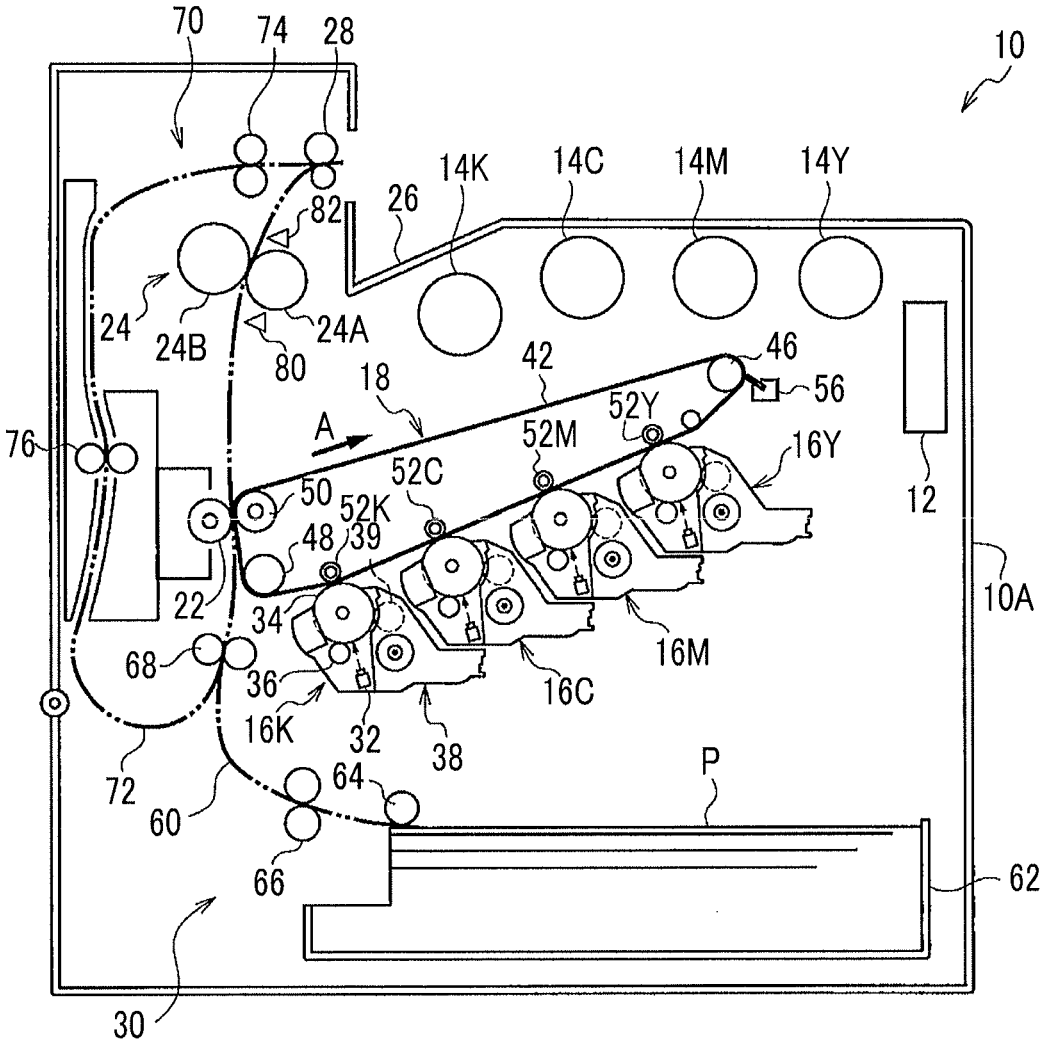
FIG. 1 is a schematic configuration diagram illustrating a configuration of an image forming apparatus according to an exemplary embodiment.

Hereinafter, an exemplary embodiment for implementing the invention will be described in detail with reference to the accompanying drawings.

First, a configuration of an image forming apparatus 10 according to the present exemplary embodiment will be described with reference to FIG. 1. Meanwhile, hereinafter, a yellow color is denoted by Y, a magenta color is denoted by M, a cyan color is denoted by C, and a black color is denoted by K. When it is necessary to distinguish components and toner images (images) from each other for each color, a description will be given by assigning signs (Y, M, C, and K) corresponding respective colors to the ends of reference numerals. Hereinafter, when components and toner images are collectively denoted without being distinguished for each color, a description will be given by omitting signs of colors at the ends of reference numerals.

Overall Configuration

As illustrated in FIG. 1, an image processing section 12 that performs image processing for converting pieces of image data to be input into pieces of four-color tone data of Y, M, C, and K is provided inside an apparatus main body 10A of the image forming apparatus 10.

In addition, image forming units 16 that form toner images of respective colors are disposed at intervals on the center side of the apparatus main body 10A so as to be inclined with respect to a horizontal direction. In addition, a primary transfer unit 18 to which tonner images, formed by the image forming units 16 of the respective colors, are to be multiply transferred is disposed above the image forming units 16 of the respective colors in a vertical direction.

Further, a secondary transfer roller 22 that transfers the toner images, multiply transferred to the primary transfer unit 18, to paper P as an example of a recording medium transported along a transport path 60 by a supply transporting unit 30 to be described later is provided on the lateral side of the primary transfer unit 18 (on the left side in FIG. 1).

A fixing device 24 as an example of a transport section that transports the paper P with an image formation surface of the paper interposed therebetween is provided on a downstream side of the secondary transfer roller 22 in a transport direction of the paper P (hereinafter, referred to as a "paper transport direction"). In addition, the fixing device 24 fixes the toner image transferred to the paper P onto the paper P by heat and pressure.

The fixing device 24 according to the present exemplary embodiment includes a heating belt 24A and a pressing roller 24B. The fixing device 24 is a so-called induction heating (IH) fixing device which is a type of fixing device that heats the heating belt 24A using electromagnetic induction. In addition, the pressing roller 24B is driven (rotated) by a motor 112 (see FIG. 2) as an example of a driving section, and the heating belt 24A is rotated following the rotation of the pressing roller 24B.

In addition, an exit roller 28 that discharges the paper P having the toner image fixed thereto to an exit section 26, provided in the upper portion of the apparatus main body 10A of the image forming apparatus 10, is provided on the downstream side of the fixing device 24 in the paper transport direction.

On the other hand, the supply transporting unit 30 that supplies and transports the paper P is provided on the lower and lateral sides of the image forming unit 16 in the vertical direction. In addition, four toner cartridges 14 (14K to 14Y), provided to be attachable to and detachable from the front surface of the apparatus main body 10A and filled with a toner replenished to a developing device 38, are disposed above the primary transfer unit 18 in the vertical direction for the respective colors so as to be lined up in the width direction of the apparatus. The toner cartridge 14 of each color is formed to have a cylindrical shape extending in the depth direction of the apparatus, and is connected to the developing device 38 of each color through a replenishing pipe not shown in the drawing.

Image Forming Unit

All of the image forming units 16 of the respective colors are configured in the same manner as illustrated in FIG. 1. The image forming unit 16 includes a cylindrical image holding body 34 which is rotatable, and a charger 36 that charges the surface of the image holding body 34.

In addition, the image forming unit 16 includes a light emitting diode (LED) head 32 that irradiates the charged surface of the image holding body 34 with exposure light. In addition, the image forming unit 16 includes the developing device 38 that develops an electrostatic latent image, formed by the exposure light irradiated by the LED head 32, using a developer (toner charged to a negative electrode in the present exemplary embodiment) and visualizes the developed electrostatic latent image as a toner image. In addition, the image forming unit 16 includes a cleaning blade, not shown in the drawing, which cleans the surface of the image holding body 34.

A developing roller 39 is disposed in the developing device 38 so as to face the image holding body 34, and the developing device 38 develops an electrostatic latent image formed in the image holding body 34 by the developing roller 39 using a developer and visualizes the developed electrostatic latent image as a toner image.

The charger 36, the LED head 32, the developing roller 39, and the cleaning blade are disposed in this order from the upstream side toward the downstream side of the image holding body 34 in the rotation direction so as to face the surface of the image holding body 34.

Transfer Section (Primary Transfer Unit and Secondary Transfer Roller)

The primary transfer unit 18 includes an endless intermediate transfer belt 42 and a driving roller 46 on which the intermediate transfer belt 42 is wound. The driving roller 46 is driven (rotated) by a motor 114 (see FIG. 2) as an example of a driving section to circulate the intermediate transfer belt 42 in a direction of an arrow A. In addition, in the present exemplary embodiment, a driving speed of the intermediate transfer belt 42 driven by the driving of the motor 114 through the driving roller 46 is set to be higher than a driving speed of the pressing roller 24B driven by the motor 112. That is, a transport speed of the paper P transported by the intermediate transfer belt 42 and the secondary transfer roller 22 to be described later is set to be higher than a transport speed of the paper P transported by the fixing device 24.

In addition, the primary transfer unit 18 has the intermediate transfer belt 42 wound thereon, and includes a tension applying roller 48 that applies tension to the intermediate transfer belt 42, and an assist roller 50 which is disposed above the tension applying roller 48 in the vertical direction and is rotated following the intermediate transfer belt 42. In addition, the primary transfer unit 18 includes primary transfer rollers 52 that are respectively disposed on sides opposite to the image holding bodies 34 of the respective colors with the intermediate transfer belt 42 interposed therebetween.

With such a configuration, toner images of Y, M, C, and K colors sequentially formed on the respective image holding bodies 34 of the image forming units 16 of the respective colors are multiply transferred onto the intermediate transfer belt 42 by the primary transfer rollers 52 of the respective colors.

Further, a cleaning blade 56 that cleans the surface of the intermediate transfer belt 42 while being in contact with the surface of the intermediate transfer belt 42 is disposed on a side opposite to the driving roller 46 with the intermediate transfer belt 42 interposed therebetween.

In addition, the secondary transfer roller 22 that transfers a toner image, transferred onto the intermediate transfer belt 42, to paper P to be transported is provided on a side opposite to the assist roller 50 with the intermediate transfer belt 42 interposed therebetween. The secondary transfer roller 22 is grounded, the assist roller 50 constitutes a counter electrode of the secondary transfer roller 22, and a secondary transfer voltage is applied to the assist roller 50, thereby transferring the toner image to the paper P. Meanwhile, the intermediate transfer belt 42 and the secondary transfer roller 22 are examples of transport sections of the present invention.

Supply Transporting Unit

The supply transporting unit 30 is disposed below the image forming units 16 in the vertical direction within the apparatus main body 10A, and includes a paper feeding member 62 in which plural pieces of paper P are accumulated.

Further, the supply transporting unit 30 includes a paper feeding roller 64 that sends out the pieces of paper P accumulated in the paper feeding member 62 to the transport path 60, a separation roller 66 that separates the pieces of paper P sent out by the paper feeding roller 64 one by one, and a positioning roller 68 that adjusts a transport timing of the paper P. The rollers are disposed in this order from the upstream side toward the downstream side in the paper transport direction.

In addition, the positioning roller 68 is connected to a motor for rotating the positioning roller 68 through a clutch mechanism not shown in the drawing. In the image forming apparatus 10, the clutch mechanism is set to be in a non-connection state until the paper P reaches a position where the positioning roller 68 is installed, and the tip of the paper P in the paper transport direction is made to abut on the positioning roller 68. Thereby, the image forming apparatus 10 performs positioning by correcting the inclination of the paper P with respect to the paper transport direction.

The clutch mechanism is set to be in a connection state after the positioning is performed, and thus the positioning roller 68 is rotated, thereby transporting the paper P.

With such a configuration, the paper P supplied from the paper feeding member 62 is sent out to a contact portion (secondary transfer position) between the intermediate transfer belt 42 and the secondary transfer roller 22 by the rotating positioning roller 68 at a determined timing.

The paper P transported to the fixing device 24 is heated by the heating belt 24A, and is pressed by the heating belt 24A and the pressing roller 24B, thereby fixing a toner image onto one surface (image formation surface) of the paper P.

Further, the supply transporting unit 30 includes a double-sided transport device 70 which is used to form a toner image on one surface of paper P without discharging the paper, having the other surface onto which a toner image is fixed by the fixing device 24, to the exit section 26 by the exit roller 28 as it is.

The double-sided transport device 70 includes a double-sided transport path 72 through which the paper P, having the front and back sides reversed, is transported from the exit roller 28 toward the positioning roller 68, and a transport roller 74 and a transport roller 76 that transport the paper P along the double-sided transport path 72.

Others

The image forming apparatus 10 includes a paper detection sensor 80 provided on the upstream side of the fixing device 24 in the paper transport direction along the transport path 60, and a paper detection sensor 82 provided on the downstream side thereof. The paper detection sensors 80 and 82 according to the present exemplary embodiment are reflective sensors that include a set of light emitting element and light receiving element. The paper detection sensors 80 and 82 irradiate a detection position on the transport path 60 corresponding to the installation position with light from the light emitting element. In addition, the paper detection sensors 80 and 82 output a signal (hereinafter, referred to as a "detection signal") of a signal level corresponding to the amount of light received by the light receiving element. The light emitted from the light emitting element is reflected by the paper P during a period for which the paper P is transported through the detection position. Therefore, the paper detection sensors 80 and 82 output detection signals of different signal levels during a period for which the paper P is transported through the detection position and a period for which the paper is not transported through the detection position.

As described above, reflective sensors are used as the paper detection sensors 80 and 82 in the present exemplary embodiment, but the present invention is not limited thereto. For example, other sensors such as transmissive sensors may be used.

Image Forming Process

First, pieces of tone data of respective colors are sequentially output from the image processing section 12 to the LED heads 32 of the respective colors. The surfaces of the image holding bodies 34 which are charged by the charger 36 are irradiated with exposure light emitted from the LED heads 32 in accordance with the pieces of tone data. Thereby, an electrostatic latent image is formed on the surface of each of the image holding bodies 34. The electrostatic latent images formed on the image holding bodies 34 are developed by the developing devices 38 of the respective colors, and are visualized as toner images of Y, M, C, and K colors, respectively.

Further, the toner images of the respective colors formed on the image holding bodies 34 are multiply transferred onto the circulating intermediate transfer belt 42 by the primary transfer rollers 52 of the primary transfer unit 18.

The toner images of the respective colors multiply transferred onto the intermediate transfer belt 42 are secondarily transferred onto the paper P, transported from the paper feeding member 62 along the transport path 60 by the paper feeding roller 64, the separation roller 66, and the positioning roller 68, at the secondary transfer position by the secondary transfer roller 22.

Further, the paper P having the toner images transferred thereto are transported to the fixing device 24. The toner images are then fixed onto the paper P by the fixing device 24. The paper P having the toner images fixed thereto is discharged to the exit section 26 by the exit roller 28.

On the other hand, when an image is formed on both surfaces of the paper P, the paper P having one face (surface) onto which a toner image is fixed by the fixing device 24 is not discharged to the exit section 26 by the exit roller 28 as it is. A transport direction of the paper P is switched by the reverse rotation of the exit roller 28. The paper P is then transported along the double-sided transport path 72 by the transport rollers 74 and 76.

The paper P transported along the double-sided transport path 72 is transported to the positioning roller 68 again in a state where the front and back sides thereof are reversed. After a toner image is transferred and fixed onto the other face (rear surface) of the paper P, the paper P is discharged to the exit section 26 by the exit roller 28.

Next, main electrical components of the image forming apparatus 10 according to the present exemplary embodiment will be described with reference to FIG. 2.

Figure 2:
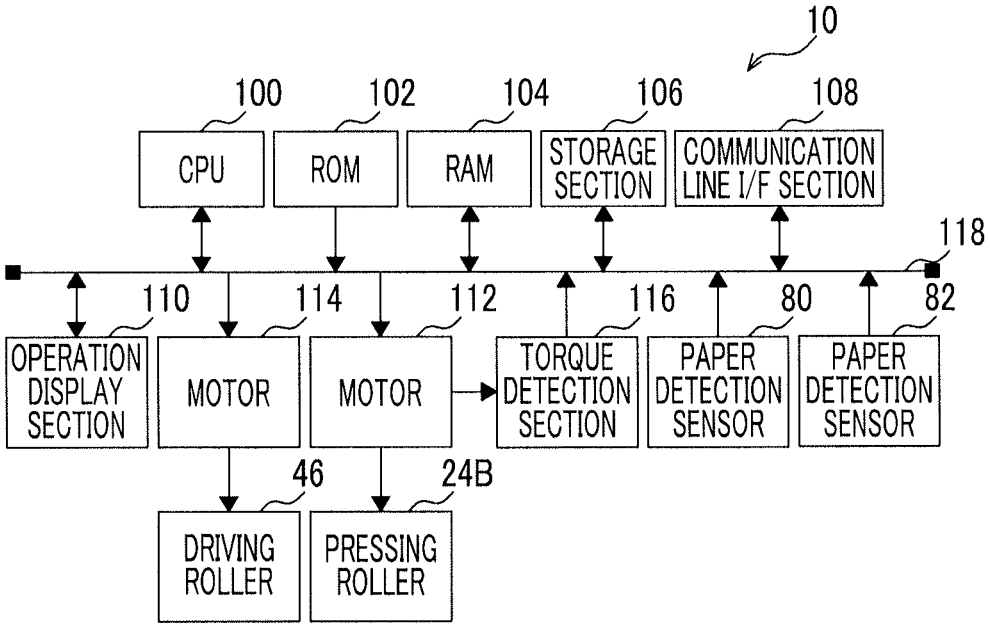
FIG. 2 is a block diagram illustrating main electrical components of the image forming apparatus according to the exemplary embodiment.

As illustrated in FIG. 2, the image forming apparatus 10 according to the present exemplary embodiment includes a central processing unit (CPU) 100 that controls the overall operation of the image forming apparatus 10 and a read only memory (ROM) 102 in which various types of programs, various types of parameters, and the like are stored in advance. In addition, the image forming apparatus 10 includes a random access memory (RAM) 104 used as a work area or the like during the execution of various types of programs by the CPU 100, and a non-volatile storage section 106 such as a flash memory.

In addition, the image forming apparatus 10 includes a communication line interface (I/F) section 108 that transmits and receives communication data to and from an external device. In addition, the image forming apparatus 10 includes an operation display section 110 receiving a user's instruction for the image forming apparatus 10 and displaying various pieces of information regarding an operation condition of the image forming apparatus 10, and the like with respect to the user. Meanwhile, the operation display section 110 includes a display which is provided with a touch panel on a display surface, on which a display button for receiving an operation instruction by executing a program and various pieces of information are displayed, and hardware keys such as a numeric keypad and a start button.

In addition, the image forming apparatus 10 includes a torque detection section 116 as an example of a detection section that detects a load (torque) of the motor 112 rotating the pressing roller 24B. The torque detection section 116 according to the present exemplary embodiment is connected to the motor 112, detects the torque of the motor 112 as a current value flowing to the motor 112, converts the current value into a voltage value, and outputs the converted voltage value.

Meanwhile, the configuration of the torque detection section 116 according to the present exemplary embodiment is not particularly limited insofar as the torque of the motor 112 may be detected. For example, a configuration in which a voltage between shunt resistors is measured to detect a current may be used as the configuration of the torque detection section 116. In addition, for example, a configuration in which resistors are provided on a path through which a current flows to the motor 112 and a voltage between the resistors is measured to detect a current may be used as the configuration of the torque detection section 116. In addition, for example, a configuration in which a current sensor is provided by a Hall element on a path through which a current flows to the motor 112 to detect a current may be used as the configuration of the torque detection section 116. Further, for example, a torque detector that detects the torque of the motor 112 may be used as the torque detection section 116.

The sections of the CPU 100, the ROM 102, the RAM 104, the storage section 106, the communication line I/F section 108, the operation display section 110, the motor 112, the motor 114, the torque detection section 116, and the paper detection sensors 80 and 82 are connected to each other through a bus 118 such as an address bus, a data bus, or a control bus.

With such a configuration, the image forming apparatus 10 according to the present exemplary embodiment has access to the ROM 102, the RAM 104, and the storage section 106, and transmits and receives communication data to and from an external device through the communication line I/F section 108 by the CPU 100. In addition, the image forming apparatus 10 acquires various pieces of instruction information through the operation display section 110 and displays various pieces of information on the operation display section 110 by the CPU 100. In addition, the image forming apparatus 10 controls the motor 112, controls the motor 114, and acquires a voltage value which is output from the torque detection section 116, by the CPU 100.

Further, the image forming apparatus 10 acquires a detection signal which is output from each of the paper detection sensors 80 and 82 by the CPU 100. Therefore, the image forming apparatus 10 detects a timing at which each of the tip and the rear end of the paper P in the paper transport direction passes through a detection position obtained by each of the paper detection sensors 80 and 82 by the CPU 100, based on a variation in a signal level of the acquired detection signal. Meanwhile, hereinafter, the tip and the rear end of the paper P in the paper transport direction will be simply referred to as the tip and the rear end of the paper P.

Incidentally, the image forming apparatus 10 according to the present exemplary embodiment has a detection function of detecting the thickness of the paper P.

Figure 3:
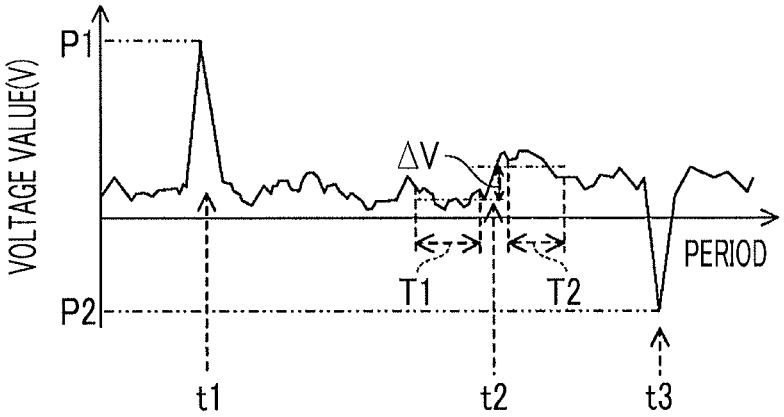
FIG. 3 is a graph illustrating an example of time-series data of detection results obtained by a torque detection section according to the exemplary embodiment.
Figure 4:
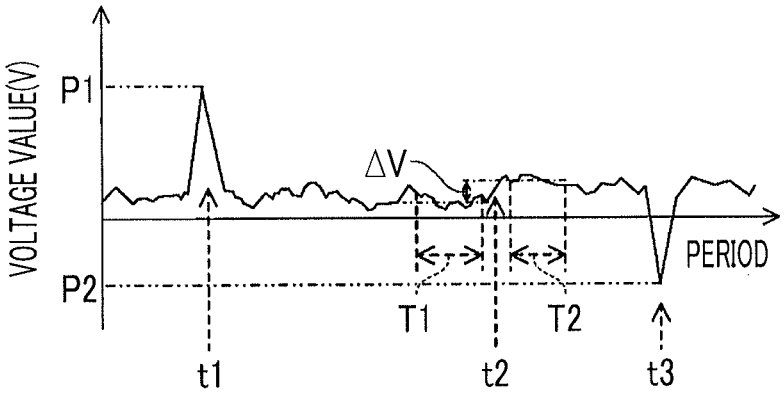
FIG. 4 is a graph illustrating an example of time-series data of detection results obtained by the torque detection section according to the exemplary embodiment.
Figure 5:
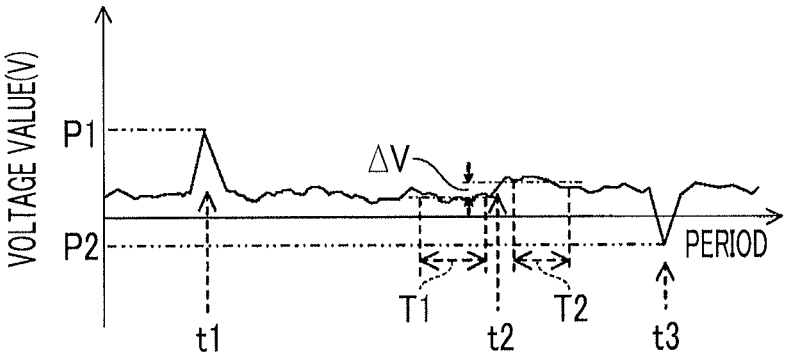
FIG. 5 is a graph illustrating an example of time-series data of detection results obtained by the torque detection section according to the exemplary embodiment.
Figure 6:
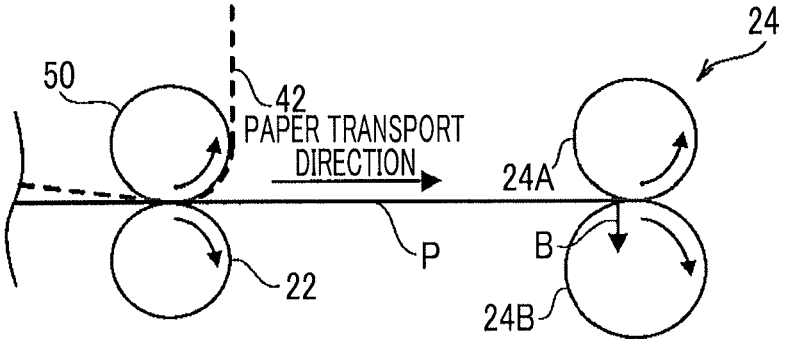
FIG. 6 is a schematic configuration diagram illustrating a timing at which paper enters a fixing device, according to the exemplary embodiment.
Figure 7:
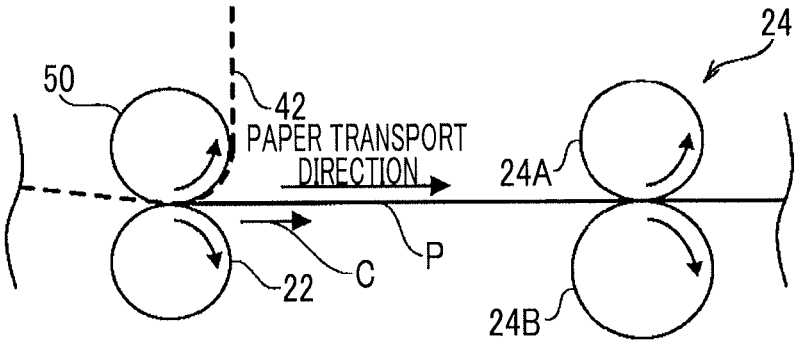
FIG. 7 is a schematic configuration diagram illustrating a timing at which paper is discharged from a secondary transfer roller and an intermediate transfer belt, according to the exemplary embodiment.
Figure 8:
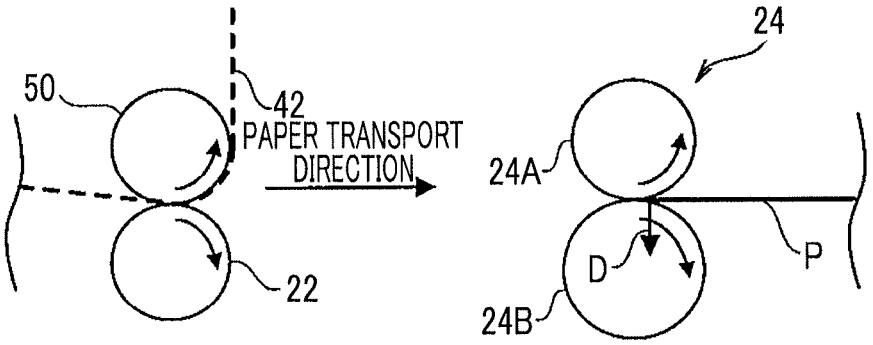
FIG. 8 is a schematic configuration diagram illustrating a timing at which paper is discharged from the fixing device, according to the exemplary embodiment.

The detection function will be described in detail with reference to FIGS. 3 to 8. Meanwhile, FIGS. 3 to 5 illustrate time-series data of voltage values which are output from the torque detection section 116 from a point in time when the tip of paper P passes through a detection position obtained by the paper detection sensor 80 until a point in time when the rear end of the paper P passes through a detection position obtained by the paper detection sensor 82, with respect to pieces of paper P having three types of thicknesses (basis weights). In addition, FIG. 3 illustrates an example of time-series data of paper P having a basis weight of 256 g/m$^2$, FIG. 4 illustrates an example of time-series data of paper P having a basis weight of 157 g/m$^2$, FIG. 5 illustrates an example of time-series data of paper P having a basis weight of 82 g/m$^2$. In addition, FIGS. 6 to 8 are diagrams for describing the time-series data of the voltage values illustrated in FIGS. 3 to 5, and illustrate transport positions of paper P. In order to avoid complication, in FIGS. 6 to 8, the intermediate transfer belt 42 is indicated by a dashed line.

First, as illustrated in FIGS. 3 to 5, regarding the voltage values which are output from the torque detection section 116, a peak value P1 projecting upward is set at a timing t1. Thereafter, a value larger than the previous value is set at a timing t2, and a peak value P2 projecting downward is set at a timing t3. Meanwhile, in FIGS. 3 to 5, a variation in the voltage value before and after the timing t2 (difference between an average value of the voltage values during a period T1 before the timing t2 and an average value of the voltage values during a period T2 after the timing t2) is indicated as ΔV.

Next, a principle of time-series variations in voltage values illustrated in FIGS. 3 to 5 will be described with reference to FIGS. 6 to 8.

As illustrated in FIG. 6, when the paper P enters the fixing device 24, a force in a direction opposite to the rotation direction of the pressing roller 24B (force in a direction of an arrow B in FIG. 6) is applied to the pressing roller 24B, and thus a torque of the motor 112 increases. Therefore, a voltage value which is output by the torque detection section 116 also increases to be thereby set to the peak value P1. Thereafter, the paper P is transported in a state of being inserted into the fixing device 24, and the force in the opposite direction which is applied when the paper P enters the fixing device 24 is not applied, and thus the voltage value is decreased.

Next, as illustrated in FIG. 7, when the paper P is discharged from the secondary transfer roller 22 and the intermediate transfer belt 42 on the upstream side of the fixing device 24, a force applied in the rotation direction of the pressing roller 24B is not applied by a force for extruding the paper P (force in a direction of an arrow C in FIG. 7). For this reason, the torque of the motor 112 increases, and thus the voltage value which is output by the torque detection section 116 also increases (ΔV illustrated in FIGS. 3 to 5). Meanwhile, it is considered that the generation of a force for extruding the paper P is caused by the above-mentioned transport speed of the paper P transported by the secondary transfer roller 22 and the intermediate transfer belt 42 being higher than the transport speed of the paper P transported by the fixing device 24.

Further, as illustrated in FIG. 8, when the paper P is discharged from the fixing device 24, a force in the same direction (force in a direction of an arrow D in FIG. 8) as the rotation direction of the pressing roller 24B is applied to the pressing roller 24B, and thus a torque of the motor 112 decreases. Therefore, a voltage value which is output by the torque detection section 116 also decreases to be thereby set to the peak value P2.

That is, the timing t1 illustrated in FIGS. 3 to 5 is a timing when the paper P enters the fixing device 24 as illustrated in FIG. 6, and the timing t2 is a timing when the paper P is discharged from the intermediate transfer belt 42 and the secondary transfer roller 22 illustrated in FIG. 7. In addition, the timing t3 illustrated in FIGS. 3 to 5 is a timing when the paper P is discharged from the fixing device 24 as illustrated in FIG. 8.

In addition, as illustrated in FIGS. 3 to 5, the value of the peak value P1 is set to a value that increases as the paper P becomes thicker, and the value of the peak value P2 is set to a value that decreases as the paper P becomes thicker. In addition, the variation ΔV increases as the paper P becomes thicker.

However, a period during which a voltage value increases and decreases before and after the timing t1 and a period during which a voltage value decreases and increases before and after the timing t3 are shorter than a period during which a variation in voltage value before and after the timing t2 is relatively small.

Figure 9:
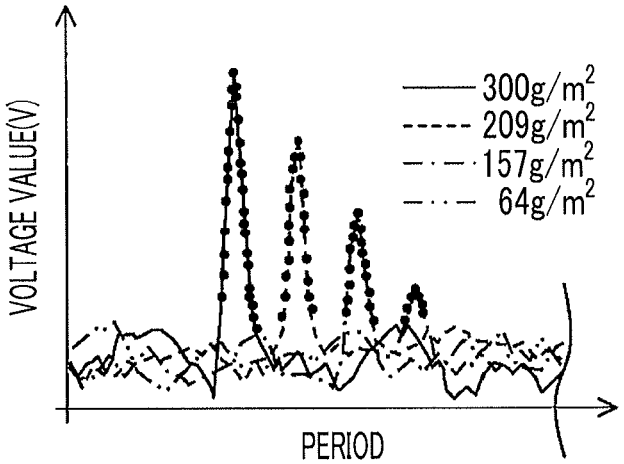
FIG. 9 is a graph illustrating a detection interval based on the torque detection section according to the exemplary embodiment.
Figure 10:
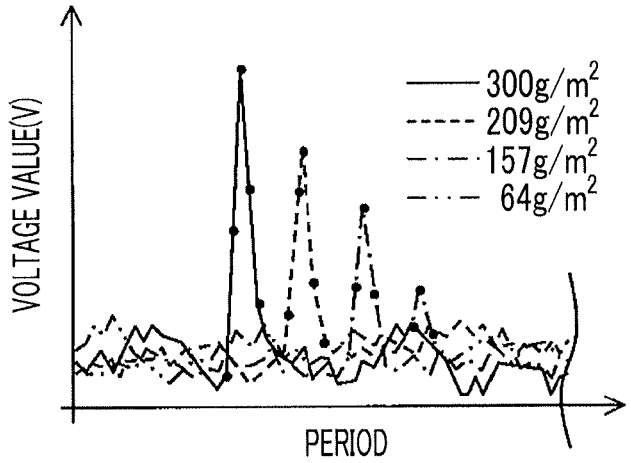
FIG. 10 is a graph illustrating a detection interval based on the torque detection section according to the exemplary embodiment.
Figure 11:
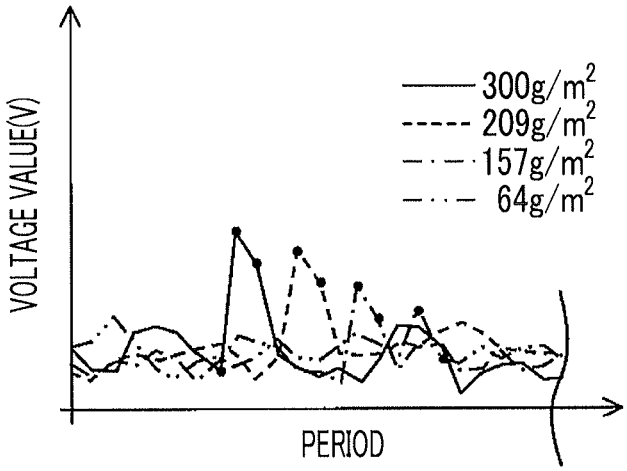
FIG. 11 is a graph illustrating a detection interval based on the torque detection section according to the exemplary embodiment.

For this reason, as illustrated in FIGS. 9 to 11, the peak values P1 and P2 may not be likely to be detected with a high level of accuracy depending on detection intervals (sampling rates) of voltage values obtained by the torque detection section 116. In this case, even when the thickness of the paper P is derived from the peak values P1 and P2, the thickness of the paper P is not derived with a high level of accuracy. Meanwhile, all of FIGS. 9 to 11 illustrate time-series data of voltage values which are output by the torque detection section 116 during a period before and after a timing t1 with respect to pieces of paper P having four types of thicknesses. In addition, FIG. 9 illustrates the time-series data when the detection interval is 1 ms, FIG. 10 illustrates the time-series data when the detection interval is 10 ms, and FIG. 11 illustrates the time-series data when the detection interval is 25 ms. In addition, all of black dots illustrated in FIGS. 9 to 11 indicate detection points (sampling points) of the voltage values obtained by the torque detection section 116.

Consequently, the image forming apparatus 10 according to the present exemplary embodiment derives the thickness of paper P from a variation ΔV in a voltage value which is output from the torque detection section 116 during periods T1 and T2 before and after the paper P is discharged from the intermediate transfer belt 42 and the secondary transfer roller 22.

Next, a process of specifying the timing t2 will be described. The image forming apparatus 10 according to the present exemplary embodiment derives a difference between a timing when the tip of the paper P passes through a detection position obtained by the paper detection sensor 80 and a timing when the rear end of the paper P passes through the detection position obtained by the paper detection sensor 80, and the length of the paper P in the paper transport direction from the transport speed of the paper P at the detection position obtained by the paper detection sensor 80. Meanwhile, when a user's image forming instruction is input, the length of the paper P in the paper transport direction which is set in advance may be used.

The image forming apparatus 10 specifies the timing t2 based on the timing when the tip of the paper P passes through the detection position obtained by the paper detection sensor 80, the length of the paper P, and the transport speed of the paper P transported by the intermediate transfer belt 42 and the secondary transfer roller 22.

Meanwhile, a process of specifying the timing t2 is not limited to the above-described process. For example, the image forming apparatus 10 may specify, as the timing t2, a timing when a voltage value is set to a value within a range, determined in advance as a range in which the paper is being transported by the intermediate transfer belt 42, the secondary transfer roller 22, and the fixing device 24, and then exceeds a threshold value equal to or greater than an upper limit in the range, or a timing when a variation in voltage value per unit period exceeds a threshold value. The range determined in advance includes, for example, a range of a voltage value during a period in which a variation in the voltage value for each detection interval mentioned above is within an allowable range (for example, a range of ±10%) after the voltage value is decreased from the peak value P1.

Next, reference will be made to FIG. 12 to describe a process of deriving the thickness of paper P from the difference (variation ΔV) in the average value of voltage values between the periods T1 and T2 before and after the timing t2 specified by the above-described process.

As described above, the variation ΔV is set to be a value that increases as the paper P becomes thicker. Consequently, in the present exemplary embodiment, voltage values output from the torque detection section 116 which correspond to thicknesses of plural types of pieces of paper P are measured in advance by a real machine of the image forming apparatus 10, an experiment using pieces of paper P having plural types of thicknesses, and the like, and variations ΔV are derived in advance. Examples of average values of voltage values during the periods T1 and T2 and variations ΔV which are obtained in advance with respect to pieces of paper P having four types of thicknesses are shown in the following Table 1. Meanwhile, each of the average values and the variations ΔV shown in Table 1 indicates a value obtained by being rounded to the second decimal place.

TABLE 1

| | paper A (basis weight: 256 g/m$^2$) | paper B (basis weight: 209 g/m$^2$) | paper C (basis weight: 157 g/m$^2$) | paper D (basis weight: 82 g/m$^2$) |
|---|---|---|---|---|
| average value of voltage values during period T1 | 0.11 | 0.14 | 0.20 | 0.18 |
| average value of voltage values during period T2 | 0.27 | 0.25 | 0.23 | 0.22 |
| variation ΔV | 0.16 | 0.11 | 0.04 | 0.04 |

Figure 12:
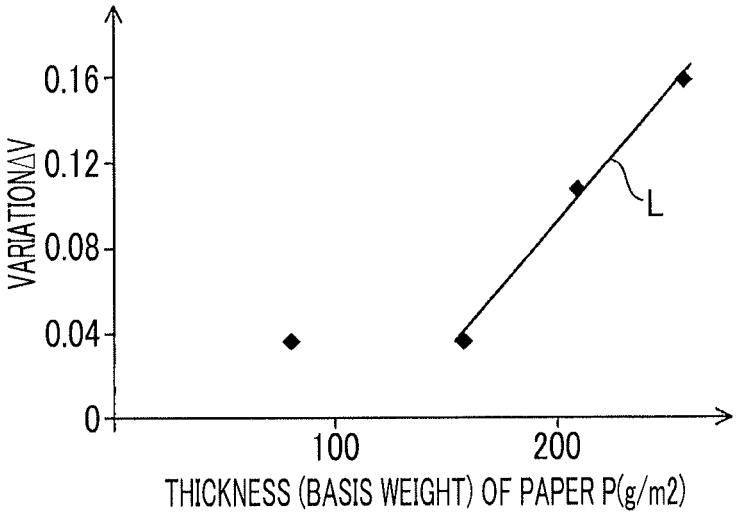
FIG. 12 is a graph illustrating an example of a relationship between a variation and a thickness of paper, according to the exemplary embodiment.

As illustrated in FIG. 12, results obtained in advance by measurement are approximated to a primary straight line L by a method of least squares or the like. As an arithmetic expression expressing a relationship between a thickness (basis weight) T of paper P and a variation ΔV, a linear expression corresponding to the primary straight line L represented by the following expression (1) is derived in advance.

$$T=aV+b \tag{1}$$

Further, the image forming apparatus 10 derives the thickness T of the paper P from the variation ΔV using Expression (1). Meanwhile, the present invention is not limited to the above, and the thickness T of the paper P may be derived from the variation ΔV, for example, by a look-up table (LUT) or the like showing a relationship between the variation ΔV and the thickness T of the paper P.

Meanwhile, the period T1 is not particularly limited insofar as a variation in voltage value per unit period (for example, a variation in voltage value for each detection interval mentioned above) within a period between the timing t1 and the timing t2 is in a period within an allowable range (for example, a range of ±10%). For example, the period T1 may be a period within the allowable range including the center of the period between the timing t1 and the timing t2, or may be a period within the allowable range immediately before the timing t2.

In addition, the period T2 is not particularly limited insofar as a variation in voltage value per unit period within a period between the timing t2 and the timing t3 is in a period within the allowable range. For example, the period T2 may be a period within the allowable range including the center of the period between the timing t2 and the timing t3, or may be a period within the allowable range immediately after the timing t2. In addition, the length of the period T1 and the length of the period T2 may be the same as each other or may be different from each other.

Figure 13:
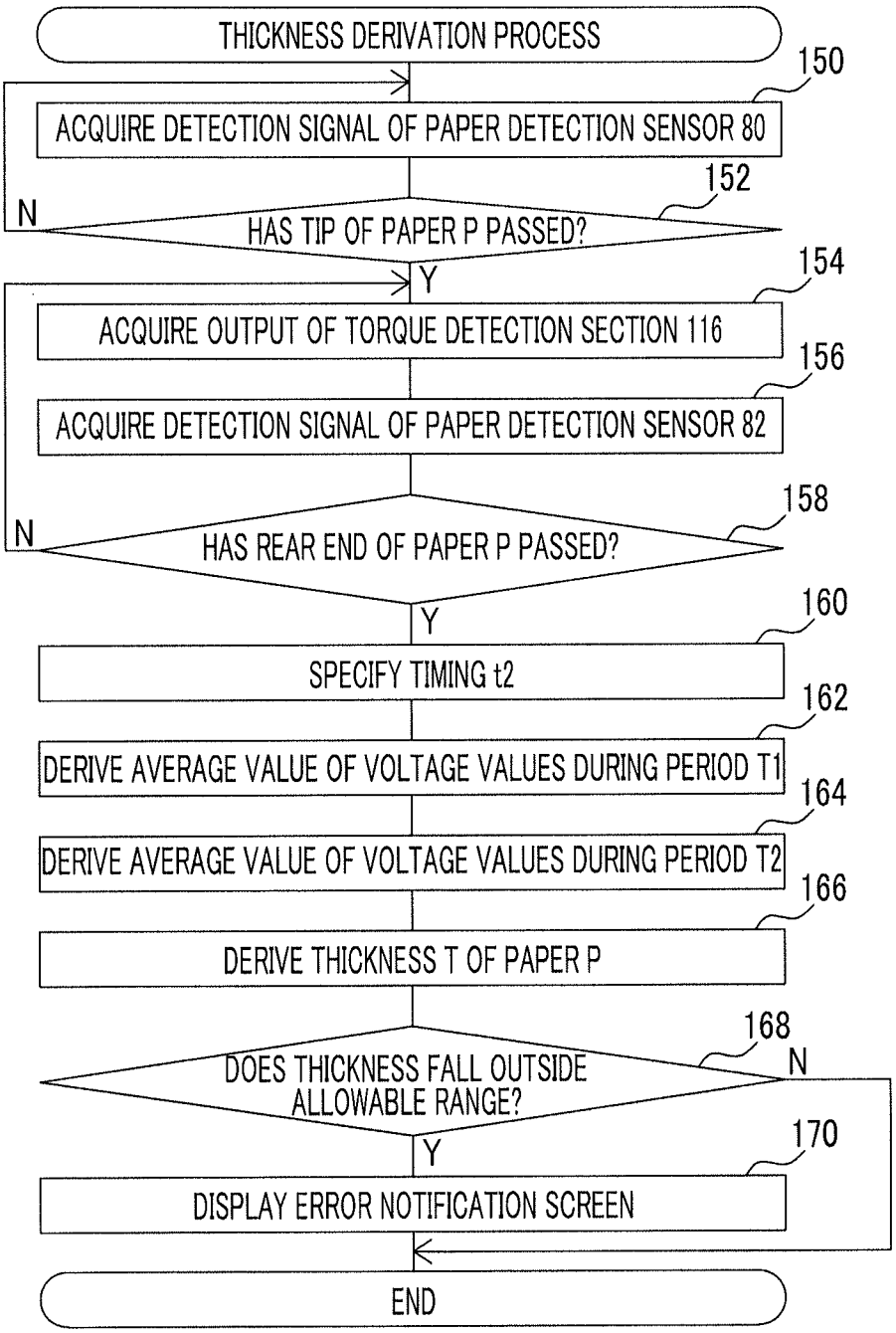
FIG. 13 is a flow chart illustrating a flow of processing of a thickness derivation process program according to the exemplary embodiment.

Next, operations of the image forming apparatus 10 according to the present exemplary embodiment during the execution of the detection function will be described with reference to FIG. 13. Meanwhile, FIG. 13 is a flow chart illustrating a flow of a process of a thickness derivation process program executed by the CPU 100 whenever an image forming instruction for paper P is input. In addition, the thickness derivation process program is installed in the ROM 102 in advance. Here, in order to avoid complication, a process of forming an image on paper P by the above-described image forming process will not be described. Here, a description will be given on the assumption that a thickness of paper P to be used is set in the image forming apparatus 10 in advance by a user.

In step 150 of FIG. 13, the CPU 100 acquires a detection signal which is output from the paper detection sensor 80. In the subsequent step 152, the CPU 100 determines whether the tip of the paper P has passed through a detection position on the transport path 60 which is obtained by the paper detection sensor 80, based on the detection signal acquired by the process of step 150.

When the result of the determination is negative, the CPU 100 returns to step 150 mentioned above. On the other hand, when the result of the determination is affirmative, the CPU proceeds to a process of step 154.

In step 154, the CPU 100 acquires a voltage value V which is output from the torque detection section 116. In the subsequent step 156, the CPU 100 acquires a detection signal which is output from the paper detection sensor 82. In the subsequent step 158, the CPU 100 determines whether the rear end of the paper P has passed through a detection position on the transport path 60 which is obtained by the paper detection sensor 82, based on the detection signal acquired by the process of step 156 mentioned above.

When the result of the determination is negative, the CPU 100 returns to step 154 mentioned above. On the other hand, when the result of the determination is affirmative, the CPU proceeds to a process of step 160. The pieces of time-series data of the voltage values V illustrated in FIGS. 3 to 5 are obtained by repeatedly performing the processes of step 154 to step 158 mentioned above.

In step 160, as described above, the CPU 100 derives the length of the paper P in the paper transport direction from a difference between a timing when the tip of the paper P passes through a detection position obtained by the paper detection sensor 80 and a timing when the rear end of the paper P passes through the detection position, and the transport speed of the paper P at the detection position obtained by the paper detection sensor 80. The CPU 100 specifies the timing t2 based on the timing when the tip of the paper P has passed through the paper detection sensor 80, the derived length of the paper P, and the transport speed of the paper P transported by the intermediate transfer belt 42 and the secondary transfer roller 22.

In step 162, the CPU 100 derives an average value of the voltage values V during the period T1 before the timing t2 specified by the process of step 160 mentioned above. In the subsequent step 164, the CPU 100 derives an average value of the voltage values V during the period T2 after the timing t2 specified by the process of step 160 mentioned above.

In step 166, the CPU 100 derives a thickness T of the paper P from a difference (variation ΔV) between the average value derived by the process of step 162 mentioned above and the average value derived by the process of step 164 mentioned above, using Expression (1) mentioned above. In the subsequent step 168, the CPU 100 determines whether the thickness T of the paper P which is derived by the process of step 166 mentioned above falls outside an allowable range.

Specifically, in the present exemplary embodiment, as an example, when an absolute value of a difference between the derived thickness T of the paper P and a thickness of the paper P which is set in advance by a user is equal to or greater than a ratio (for example, 10%) of the thickness which is determined in advance, the CPU 100 determines that the thickness of the paper falls outside the allowable range.

When the result of the determination in step 168 mentioned above is affirmative, the CPU 100 proceeds to a process of step 170.

In step 170, the CPU 100 displays an error notification screen, indicating that the thickness T of the paper P which is derived by the process of step 166 mentioned above falls outside the allowable range, on a display of the operation display section 110, and then terminates the thickness derivation process program.

Figure 14:
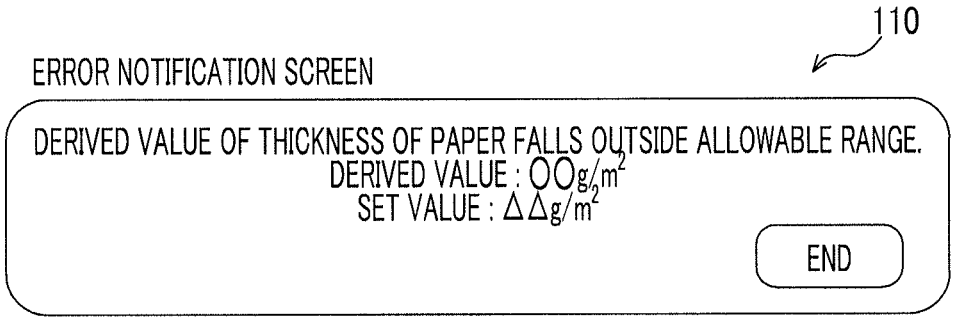
FIG. 14 is a schematic diagram illustrating an example of an error notification screen according to the exemplary embodiment.

FIG. 14 illustrates an example of the error notification screen according to the present exemplary embodiment. As illustrated in FIG. 14, in the error notification screen according to the present exemplary embodiment, information indicating that a derived thickness T falls outside an allowable range, information indicating the derived thickness T of the paper P, and information indicating a thickness of the paper P which is set in advance by a user are shown. Here, when the user terminates the display of the error notification screen, the user specifies a termination button displayed in a lower portion of the error notification screen.

On the other hand, when the result of the determination in step 168 mentioned above is negative, the CPU 100 terminates the thickness derivation process program without performing the process of the step 170 mentioned above.

As described above, in the present exemplary embodiment, the thickness of the paper P is derived based on the torque of the motor 112 that drives the pressing roller 24B of the fixing device 24. A force for pinching an image formation surface of the paper P by the fixing device 24 is stronger than those of other transport sections such as the secondary transfer roller 22, the intermediate transfer belt 42, the positioning roller 68, and the separation roller 66. Therefore, according to the present exemplary embodiment, the thickness of the paper P is derived with a high level of accuracy, compared to a case where the thickness of the paper P is derived based on the torque of the motor that drives the above-mentioned other transport sections.

While the exemplary embodiment has been described so far, the technical scope of the present invention is not limited to the scope described in the above-described exemplary embodiment. Various modifications and improvement may be made to the above-described exemplary embodiment without departing from the scope of the invention, and the exemplary embodiment subjected to the modifications and improvements is also included in the technical scope of the present invention.

In addition, the above-described exemplary embodiment does not limit the invention according to claims, and not all combinations of the features described in the exemplary embodiment are essential. The above-described exemplary embodiment includes various stages of invention, and various inventions are extracted by combinations of plural components disclosed. Even when some of all components described in the exemplary embodiment are deleted, a configuration in which some of the components are deleted may be extracted as the invention as long as effects are obtained.

For example, in the above-described exemplary embodiment, a case where the thickness of paper P is derived from a variation ΔV has been described using Expression (1) mentioned above, but the present invention is not limited thereto. For example, a configuration in which it is determined whether the paper P is thick paper of which the thickness exceeds a thickness determined in advance may be adopted by comparing the variation ΔV and a threshold value. In this case, for example, a configuration is illustrated in which the paper P is determined to be thick paper when the variation ΔV exceeds a variation (0.10 in the example of FIG. 12) corresponding to a basis weight (for example, 200 $g/m^2$) determined in advance as a value of thick paper.

In addition, in the above-described exemplary embodiment, a description has been given of a case where the intermediate transfer belt 42, the secondary transfer roller 22, and the fixing device 24 are used as plural transport sections of the present invention, but the present invention is not limited thereto. For example, as the plural transport sections of the present invention, other transport sections such as the positioning roller 68, the intermediate transfer belt 42, and the secondary transfer roller 22, or the separation roller 66 and the positioning roller 68 which transport paper P with an image formation surface of the paper interposed therebetween may be used. Also in this case, similarly to the above-described exemplary embodiment, the thickness of the paper P is derived from a variation ΔV in a load of a driving section that drives a transport section located on a downstream side in a paper transport direction.

In addition, when a transport section located on an upstream side of a transport path is used as the transport section of the present invention, a configuration may be adopted in which a member located on a downstream side of the transport path is controlled based on the derived thickness of the paper P.

In this case, similarly to the above-described exemplary embodiment, for example, the thickness of the paper P is derived from a variation ΔV in a load (torque) of a motor that drives the positioning roller 68. A configuration is illustrated in which a voltage value of a secondary transfer voltage to be applied to the assist roller 50 in accordance with the derived thickness of the paper P. Further, a configuration in which the transport speed of the paper P in the transport path 60 at the downstream side of the positioning roller 68 is changed in accordance with the derived thickness of the paper P, or a configuration in which the amount of heat obtained by heating of the heating belt 24A is also illustrated.

In addition, in the above-described exemplary embodiment, a description has been given of a case where a transport speed of paper P transported by a transport section (the intermediate transfer belt 42 and the secondary transfer roller 22) located on an upstream side in the paper transport direction is higher than a transport speed of the paper P transported by a transport section (fixing device 24) located on a downstream side in the paper transport direction, but the present invention is not limited thereto. For example, a configuration may be adopted in which the transport speed of the paper P transported by the transport section located on the upstream side in the paper transport direction is lower than the transport speed of the paper P transported by the transport section located on the downstream side in the paper transport direction.

Figure 15:
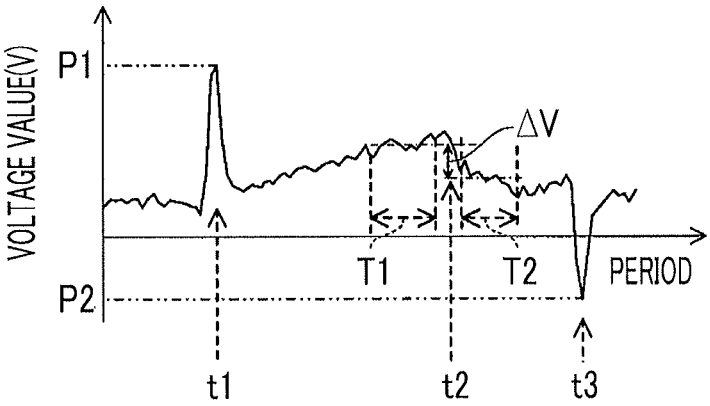
FIG. 15 is a graph illustrating an example of time-series data of detection results obtained by a torque detection section according to a modified example.

A graph, corresponding to FIG. 3 of the above-described exemplary embodiment, according to this configuration example is illustrated in FIG. 15. Similarly to FIG. 3, FIG. 15 also illustrates an example of time-series data of voltage values which are output from the torque detection section 116 from a point in time when the tip of paper P passes through a detection position obtained by the paper detection sensor 80 to a point in time when the rear end of the paper P passes through a detection position obtained by the paper detection sensor 82. In addition, timings t1, t2, and t3, periods T1 and T2, and a variation ΔV in FIG. 15 correspond to the timings t1, t2, and t3, the periods T1 and T2, and the variation ΔV in FIG. 3. Also in this configuration example, the thickness of the paper P is derived using the variation ΔV, similar to the above-described exemplary embodiment.

In addition, in the above-described exemplary embodiment, a case where the present invention is applied to an image forming apparatus has been described, but the present invention is not limited thereto. For example, the present invention may be applied to another apparatus, such as an image reading apparatus or auto document feeder (ADF), which includes transport sections transporting a recording medium in a state of being interposed therebetween.

In addition, in the above-described exemplary embodiment, a description has been given of a case where a thickness derivation process program is installed in the ROM 102 in advance, but the present invention is not limited thereto. For example, a configuration in which the thickness derivation process program is provided in a state of being stored in a storage medium such as a compact disk read only memory (CD-ROM), or a configuration in which the thickness derivation process program is provided through a network may be adopted.

Further, in the above-described exemplary embodiment, a description has been given of a case where a thickness derivation process is realized by a software configuration using a computer by executing a program, but the present invention is not limited thereto. For example, a configuration may be adopted in which the thickness derivation process is realized by a hardware configuration or a combination of a hardware configuration and a software configuration.

In addition, the configuration (see FIGS. 1 and 2) of the image forming apparatus 10 which is described in the above-described exemplary embodiment is an example, and it is needless to say that unnecessary portions may be deleted or new portions may be added without departing from the scope of the invention.

In addition, a flow (see FIG. 13) of the thickness derivation process program described in the above-described exemplary embodiment is also example, and it is needless to say that unnecessary steps may be deleted, new steps may be added, or a processing sequence is changed without departing from the scope of the invention.

Further, the configuration (see FIG. 14) of the error notification screen which is described in the above-described exemplary embodiment is also an example, and it is needless to say that some pieces of information may be deleted, new pieces of information may be added, or a display position may be changed without departing from the scope of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport device comprising:

a first transport section that is driven at a first transport speed and transports a recording medium interposed therein;

a second transport section that is driven at a speed different from the first transport speed, is located at a downstream of the first transport section in a transport direction, and transports the recording medium interposed therein;

a detection section that detects a varying driving load of the second transport section both before and after the recording medium is discharged from the first transport section, such that a difference between values of the varying driving load is a variation in the varying driving load; and a derivation section that calculates the variation and derives a thickness of the recording medium based on the variation, wherein the transport device determines a timing based on when the varying driving load of the second transport section exceeds a threshold value after the recording medium has been conveyed by both the first and second transport sections, wherein the timing is a timing at which the recording medium is discharged from the first transport section, and the detection section detects the varying driving load before and after the timing; and a control section that controls, based on the thickness, at least one of a voltage value of a transfer voltage to be applied to an assist roller, a transport speed of the recording medium, and an amount of heat obtained by heating a heating member.

2. The transport device according to claim 1, wherein the variation between the values of the varying driving load is determined from a difference between an average value of the load during a first period of time in which a variation in the load per unit period within a period of time between a time when the recording medium enters the second transport section and a time when the recording medium is discharged from the first transport section falls within a first allowable range and an average value of the load during a second period of time in which a variation in the load per unit period within a period of time between the time when the recording medium is discharged from the first transport section and a time when the recording medium is discharged from the second transport section falls within a second allowable range.

3. An image forming apparatus comprising:

an image forming section that forms an image on a recording medium;

a first transport section that is driven at a first transport speed and transports the recording medium interposed therein;

a second transport section that is driven at a speed different from the first transport speed, is located at a downstream of the first transport section in a transport direction, and transports the recording medium interposed therein;

a detection section that detects a varying driving load of the second transport section both before and after the recording medium is discharged from the first transport section, such that a difference between values of the varying driving load is a variation in the varying driving load; and a derivation section that calculates the variation and derives a thickness of the recording medium based on the variations, wherein the image forming apparatus determines a timing based on when the varying driving load of the second transport section exceeds a threshold value after the recording medium has been conveyed by both the first and second transport sections, wherein the timing is a timing at which the recording medium is discharged from the first transport section, and the detection section detects the varying driving load before and after the timing; and a control section that controls, based on the thickness, at least one of a voltage value of a transfer voltage to be applied to an assist roller, a transport speed of the recording medium, and an amount of heat obtained by heating a heating member.

4. The image forming apparatus according to claim 3, wherein the second transport section is a fixing device that fixes the image onto the recording medium.

* * * * *